United States Patent [19]

Bitterly

[11] Patent Number: 4,685,253

[45] Date of Patent: Aug. 11, 1987

[54] STRUCTURAL MEMBER

[76] Inventor: Jack G. Bitterly, 4723 Vista De Oro Ave., Woodland Hills, Calif. 91364

[21] Appl. No.: 671,049

[22] Filed: Nov. 13, 1984

Related U.S. Application Data

[63] Continuation of Ser. No. 241,453, Mar. 6, 1981, abandoned.

[51] Int. Cl.[4] ..... E04C 3/00

[52] U.S. Cl. ..... 52/2; 52/223 R

[58] Field of Search ..... 405/292, 302; 52/108, 52/632, 223 R, 2, 223 L, 224, 225; 248/351, 354, 357, 354.3

[56] References Cited

U.S. PATENT DOCUMENTS

| | | | |
|---|---|---|---|
| 1,302,293 | 4/1919 | Blazer | 52/223 R |
| 2,857,755 | 10/1958 | Werth . | |
| 3,153,789 | 10/1964 | Ashton | 52/1 |
| 3,167,882 | 2/1965 | Abbott . | |
| 3,232,638 | 2/1966 | Hollander . | |
| 3,516,211 | 6/1970 | Rieve . | |
| 3,538,653 | 11/1970 | Meckler . | |
| 3,796,017 | 3/1974 | Meckler | 52/167 |
| 4,313,287 | 2/1982 | Romig | 52/223 R |

*Primary Examiner*—John E. Murtagh

*Attorney, Agent, or Firm*—Poms, Smith, Lande & Rose

[57] ABSTRACT

The structural member of the present invention includes a pressure tube either having a cable tensioned between its ends or being mounted within an outer member. The pressure tube is mounted such that it can move axially with respect to the cable or the outer tube. When the tube is pressurized, some of the force is absorbed in hoop stress in the tube, and some of the force is directed to the ends of the pressure tube and to the cable or the outer member either through a piston arrangement or otherwise. When compressive loads are placed on the system, it can support force up to the preload without exhibiting Euler buckling. The system is useful for long, thin columns and for long beams where ridgidity is important. The pressure tube is not subject to compressive loading because its ends are free to move axially without compressing the tube. The pressure tube may be wrapped in high tensile strength unidirectional fiber material to withstand higher hoop strees.

42 Claims, 13 Drawing Figures

STRUCTURAL MEMBER

This is a continuation of co-pending application Ser. No. 241,453 filed on Mar. 6, 1981, now abandoned.

BACKGROUND OF THE INVENTION

The present invention is a new structural member that has its greatest applicability as a column, as underlying supports for a plate, or as a beam.

Parabolic or catenary suspensions are very effective loading structures. Large uniform forces can be supported depending on the cable tension and the tensile strength of the cable. In an ordinary beam or plate, a suspension is not achieved because the beam or plate is not in tension. If one could artificially induce a tension in a beam or plate, a load could be supported as effectively as with a suspension and better than with a freely supported beam or plate. The structure necessary to anchor and to support a cable normally preclude using a suspension except for certain larger applications such as bridges. If tension can be applied without the complex structure of, for example, a suspension bridge, beams and panels could support greater loads with less deflection. It is an object of the present invention to disclose and provide a structure for artificially inducing the tension in a beam or panel so that they could be as effective as suspension supports.

Most metals have a maximum stress in compression that is approximately equal to the maximum stress in tension. In compression, however, if the length of the member is greater than 10 to 15 times the smallest cross-sectional dimension, the member is considered a column. Columns fail because they buckle or laterally deflect, which is caused by minor variations in the column, both in shape or in material homogeneity and by loads that are aligned incorrectly. The long moment arm of a column allows small variations to cause failure in a loaded column. A discussion of the mechanics of columns is set forth in *Tool Engineers Handbook,* 2d Ed., p. 101–29 (1959).

Euler discovered the mathematics of a column. He defined a quantity called the slenderness ratio as the length of the column divided by the smallest radius of gyration; L/k, where L=length and k=minimum radius of gyration. Euler determined experimentally that where the slenderness ratio is less than about 30 the column may be considered to be an ordinary compression member. Where the slenderness ratio is greater than 30, however, the effects of lateral deflection increase. Thus, if the slenderness ratio is below 30, the member can support a rather constant load as a function of the slenderness ratio, but at higher ratios, the maximum supportable load decreases as a function of the slenderness ratio.

In some applications the slenderness ratio may be decreased by increasing the diameter of the column, but the additional material adds cost and weight. In applications such as aerospace where weight is a significant factor, size reengineering may be impractical. It may also be possible to better fix the ends of the column to decrease the effective column length, and it may also be possible to restrain the midsection of a column thereby splitting the effective column length into shorter beams. Such solutions may be impractical for the intended environment.

The patent literature discloses a number of attempted solutions to this problem. For example, Meckler, U.S. Pat. No. 3,538,653 (1970) employs hydraulics to counteract some compression forces. Werth, U.S. Pat. No. 2,857,755 (1958), Abbott, U.S. Pat. No. 3,167,822 (1965) and Rieve, U.S. Pat. No. 3,516,211 (1970) disclose systems for prestressing concrete or prestressing the reinforcing rods. Hollander, U.S. Pat. No. 3,232,628 (1968) shows a prestressed tube.

One of the objects, therefore, of the present invention is to provide a column that can resist buckling even though the slenderness ratio is above 30, even substantially above 30. This helps meet an ultimate goal of providing a low cost, low weight structural member of surprising resistance to compression and buckling under what would be considered an excessive load for a column.

A further object of the present invention is to be able to take advantage of high tensile strength fiber material such as aramid fiber in a compression member even though the fiber is not rigid. It is also an object of the present invention to use such materials by converting the compressive forces into unidirectional tensile forces.

Conventional beams also have loading limits whether supported at both ends or cantilevered. For this discussion, beams are considered to be structural members such as long narrow members and long and wide plates subjected to transverse loading. In a beam, the moment is resisted jointly by tensile and compressive stresses along opposite surfaces of the beam. If at the surfaces the yield point of the material is exceeded, the beam fails.

As in the case of columns, the maximum transverse load that a beam can support without exceeding the yield point depends on the material and its configuration. For a given material and shape, increasing the thickness of the material will increase the load that a beam can support. It may be impractical, however, to change the thickness because of space or weight considerations.

A beam need not fail (i.e. the beam material need not yield) for a particular beam application to be unsatisfactory. A beam may deflect too much under load for it to be practical. The deflection depends in part on the modulus of elasticity of a material. Once the material is chosen and the configuration set, the deflection is fixed. For example, assume there is a 50 foot (15.2 m) long steel tube with a 0.82 in (21 mm) outside diameter freely supported at its ends. One would expect by calculation that it will sag at its midsection approximately 7.5 feet (2.3 m) due to its own weight. Decreasing the deflection would allow the beam to be used in many applications especially if the deflection were less than an inch. Sometimes, even for relatively short spans, small deflections are unacceptable, and stiffer supports may be necessary where a supported member must be ridgidly secured.

In certain applications where high stiffness to weight ratios are important, composites or sandwiches of aluminum and carbon, boron or silicon carbide are being used. These systems depend on the high modulus of elasticity of carbon and boron. Although better than most metals, they have a limit in their ability to reduce deflection because their modulus of elasticity is at most doubled.

It is an object of the present invention, therefore, to disclose and provide a lightweight and compact structural member capable of supporting heavier loads than heretofore thought possible.

As will be seen from the descriptions of the invention, some of the elements of the present invention will be subjected to very high pressure. In one embodiment, for example, a piston is mounted in a tube filled with fluid under extremely high pressure. The pressure will cause the inside diameter of the tube to increase as an inverse function to the modulus of elasticity of the tube material. One of the objects of the present invention, therefore, is to disclose and provide a piston-tube arrangement which effectively seals the space between the tube and piston even when the tube expands from hydraulic pressure.

It will also be shown that there is some deflection, even though small, in the beam of the present invention. One of the objects of the present invention is to further compensate for this small deflection by so arranging the parts so that the deflection may be induced in one direction perpendicular to the axis opposite the direction of the intended load. For example, an upward bow could be induced so that when the structural member was mounted horizontally, it would resist downward loads. Another object is to use two of the pre-bowed members generally parallel to each other, which could be rotated about their axis to adjust the bowing preload so that after loading the beam would be flat.

SUMMARY OF THE INVENTION

The above mentioned objects as well as other objects that will become evident herein are met by a structural member comprising a tube with end means at one end of the tube for movement in the tube. Pressurizing means operatively connected to the tube pressurizes the tube and urges the end means out of the tube. The end means is attached to the other end of the tube by connecting means which hold the end means in the tube means during pressurization whereby the pressure provides a pre-stress axially outward from the outer end of the tube means and from the end means while the tubular wall is placed in hoop tension. The compressive loads between the end means and the other end of the tube are not transmitted to the tubular wall. In one embodiment, the end means is a piston, and the connecting means is a cable between the piston and the other end of the tube. In other embodiments, the cable may be replaced by an outer tube over the first mentioned tube. In that member comprises an outer tube having closed end embodiment, the structural members at the ends of the outer tube. An inner or pressure tube is generally concentric with the outer tube and is mounted to the end of the outer tube to permit axial movement of the pressure tube with respect to the outer tube. The mounting means may include one or more pistons in the pressure tube that extend into and are movable in the pressure tube. One embodiment will show a piston extending out of each end of the pressure tube. The pistons contact the ends of the outer tube. The pressure tube is then pressurized thereby urging the pistons out of the ends of the pressure tube against the ends of the outer tube creating axial tension in the tubular wall of the outer tube and hoop tension in the tubular wall of the inner or pressure tube.

In the first mentioned embodiment (single tube, piston, cable), it is important that the piston have axial freedom of movement with respect to the tube so that compressive loads between the tube and the piston will not be converted to compressive loads on the tube. In the other embodiment (inner and outer tubes), it is important that the inner or pressure tube have axial freedom of movement with respect to the outer tube so that the compressive loads on the outer tube will not be converted to compressive loads on the pressure tube.

Thus, the present invention converts the compressive forces which tend to buckle the column into pure hoop tension on the walls of a cylinder subjected to uniform internal pressure. Hoop tension is directed tangentially so the material is not subjected to shear or torsion. The cylinder can be formed of high tensile-strength material wound on a cylindrical mandrel. Unidirectional fiber composites uniquely satisfy this requirement. Certain aramid fibers such as Kevlar (a trademark of E. I. du Pont de Nemours & Co.) and glass fiber composites can withstand more than $2.5\times10^5$ psi ($1.7\times10^6$ kPa) in tension (steel has a maximum tensile strength of about $2.0\times10^5$ psi ($1.4\times10^6$ K Pa)). The fiber material could be wet wound on a thin metal shell acting only as a pressurized winding mandrel and as a leakproof cylindrical wall. Because of the low density of material such as Kevlar composite, which is about 1/6 as dense as steel, the use of such material provides a substantially lighter and stronger structural member.

Vertical loading on a horizontal beam causes the beam to curve. For small deflections, the curve approximates an arc of a circle. Tension is in the bottom half and compression in the top half causes the bottom portion to be longer than the top portion. Therefore, the bottom of the tube has a larger radius of curvature than the top. The internal pressure, working over a greater area on the bottom than on the top exerts a force tending to increase the beam deflection or, at the very least, invalidate the equations developed to determine deflection. The increased deflection is measurable and predictable and has only slightly adverse consequences.

The present invention contemplates even utilizing this phenomenon. When one or two pistons are used with the pressure tube, they will normally be sealed by an O-ring or other type of seal. The typical O-ring is perpendicular to the tube axis. To compensate for the length increase, the O-ring in each piston may be at a slight angle to its normal position. Typically this would shorten slightly the normal bottom of the pressure tube and lengthen slightly the normal top of the pressure tube. Two tubes could be mounted in tandem and rotate relative to each other such that the angle of the O-ring relative to vertical can be changed as the orientation of the tube is changed. Likewise, the pistons could be rotated within the pressure tube. It may also be desirable to provide a small bulge in a panel or beam of the present invention by properly orienting the O-ring. The bulge may be useful where slight wall curvatures are desirable.

Instead of a piston, a resilient member such as a bellows could connect the ends of the pressure tube with the outer tube, or the pressure tube could be in two parts with a connecting bellows. A pressurized fluid can be forced through an opening in the end member, through the bellows and into the pressure tube.

The pressure in the pressure tube may be applied in many different ways. A line from a pressure source could direct pressurized gas or liquid into the pressure tube, or a force may be applied mechanically from the end wall of outer tube acting on at least one of the pistons to decrease the volume in the pressure tube. For example, a screw may be threaded in the end wall of the outer tube, and one end pushes against one of the pistons. To pressurize the pressure tube, the screw could be turned such that it would push the piston into the pressure tube thereby decreasing the volume in the tube to pressurize the inside of the pressure tube. There could also be a coupling to an outside member such that as the outside member applied greater compressive force to the outer tube, some of the load could be applied to the adjustment member to push on the piston.

The pressure tube may be filled with a variety of fluids. Gas or water can be used, but to minimize or eliminate fluid leakage, high viscosity fluids such as hydraulic oil can be used. Small particle fluid-like solids of low specific gravity such as powder may replace the fluid; even sand might be used in certain applications. Alternatively, small hollow spheres of lightweight material could displace some of the fluid. This would be beneficial for weight reduction if the hollow spheres weighed less than their corresponding volume of fluid. Compressed gas may also provide weight reduction. For example, hydrogen compressed to 6000 psi has a density of only 33 lbs/cu. ft. At the same pressure, compressed air would only weight 0.0865 lbs./lineal ft. assuming a 0.75 in I.D. tube. A leak detector could also be used to protect against fluid leaks or to anticipate problems caused by leaks as set forth in more detail hereinafter.

In the piston embodiment, an additional winding of extremely high modulus of elasticity material such as boron filament may be wound around the first fiber near the ends of the pressure tube to prevent expansion of the ends of the pressure tube and to prevent leakage of the fluid past the piston. The pressure tube may also be formed over much of its length of lightweight but low modulus of elasticity material such as aluminum. This could be threaded to an end portion of a heavier but higher modulus of elasticity such as steel. This would result in a lighter structure, and the higher modulus of steel around the piston prevents that portion of the pressure tube from expanding too much.

Alternatively, the pressure tube may be permitted to expand around at least a portion of the piston, but the outside diameter of the piston can also be made to expand with the pressure tube to maintain a more constant gap between the two, which gap would be closed by sealing means. The piston may be made to expand by having a generally hollow columnar portion integral with a base. The inside walls of the columnar portion are exposed to the high pressure acting radially, and the columnar portion can expand at the same rate as the expansion of the pressure tube to keep the gap between the two constant.

BRIEF DESCRIPTION OF THE DRAWINGS

In FIG. 11, the outer tubes are trapezoidal with the top and bottom walls slightly curved. In FIG. 12, the outer tube is a rectangle or square.

DETAILED DESCRIPTION OF THE PREFERRED EMBODIMENTS

1. Design of Structural Member. The structural member of the present invention comprises a pressure tube having tubular walls with fluid therein. An end member at one end of the tube moves in the tube. The tube is pressurized to urge the end member out of the tube, but a connecting member attached to the end member and the other end of the tube holds the end member within the tube. In one embodiment, the connecting means is a cable extending between one end of the tube to a piston, the end member. Because the piston freely moves within the tube and applies practically no lateral stress on the tube, a load pushing the piston toward the other end member (in compression) does not apply a compressive load to the tube. Thus, the piston, which seals the tube is designed to be free-acting means for eliminating the axial load on the tube from the connecting means. In another embodiment, the cable inside the tube is replaced by an outer tube surrounding the first mentioned tube. The cable will be discussed hereinafter.

Figure 1:
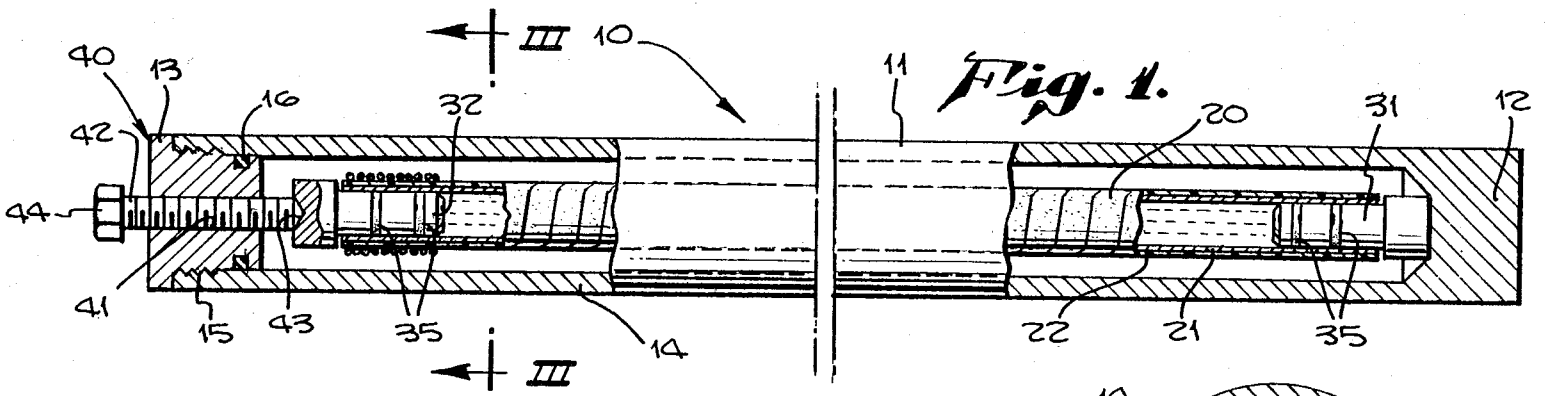
FIG. 1 is a side view, partially sectioned, of a first exemplary embodiment of the structural member of the present invention.
Figure 2:
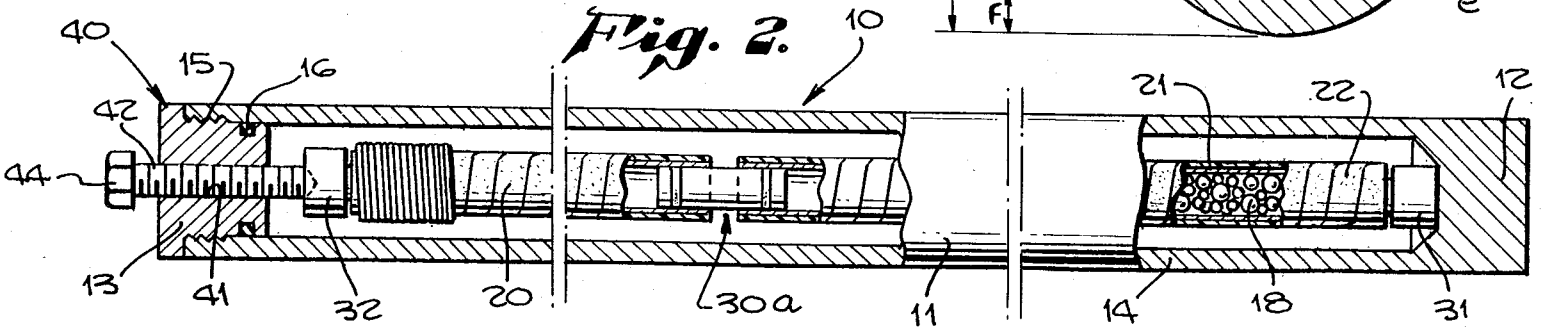
FIG. 2 is similar to FIG. 1 with certain different parts in section and with hollow spheres inside the pressure tube.

In the outer tube-inner pressure tube embodiment, the outer tube has fixed end members at its ends. As shown in FIGS. 1 and 2, structural member 10 comprises outer tube 11 having end members 12 and 13 at the ends of outer tube 11. In the first exemplary embodiment, end member 12 is integral with tubular wall 14 of the outer tube, but end member 13 is threaded at 15 into outer tube 11 and locked by means of ring 16 thereby providing access to the inside of outer tube 11. For ease of manufacture, integral end wall 12 could also be a threaded member similar to end member 13. In the second embodiment (FIG. 5) the end member 73 of outer tube 71 is welded at 72. Although the outer tube 11 has a circular cross-section in the exemplary embodiment, the cross-section may be modified as desired.

Figure 3:
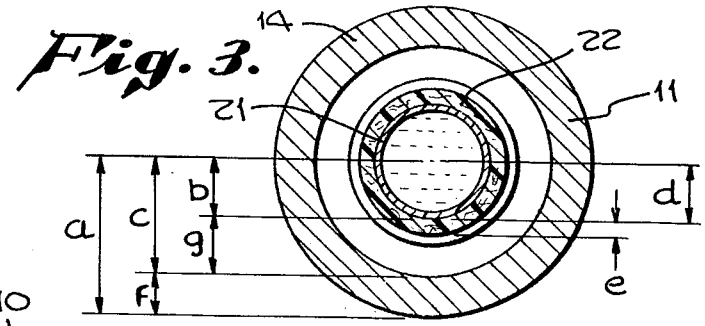
FIG. 3 is a sectional view of the structural member taken through plane III—III in FIG. 1.

A pressure tube is mounted generally concentrically with the outer tube. As shown in FIGS. 1–3 in the first exemplary embodiment, pressure tube 20 is mounted concentrically within outer tube 11. In the first exemplary embodiment, pressure tube 20 comprises a thin, metal, internal cylinder 21 around which the high tensile strength fiber 22 is wrapped. The pressure tube will be subjected to great internal pressure thereby subjecting the tubular walls to large hoop stress. Ideally, cylindrical tube 21 is only thick enough to provide a leakproof wall. The high tensile strength fiber is preferably a material such as Kevlar or glass composite, as previously discussed, and it is wet wound on cylinder 21, which also serves as a mandrel for winding the fiber. The wrapped cylinder could be replaced by a unitary cylinder for some applications.

a. The Piston Embodiment: The structural member of one embodiment of the present invention (FIGS. 1 and 2) includes a pair of pistons 31 and 32 which extend into the ends of pressure tube 20 and which are movable in the pressure tube. Each piston must be sufficiently long to allow for axial travel within the pressure tube. Because the pistons will be subjected to large compression loads, and because of their narrow diameter, their length should be kept small so that each does not become a column having a high slenderness ratio. O-rings 35 prevent leakage from within pressure tube 20 from leaking past pistons 31 and 32.

Pressurizing means pressurize the inside of the pressure tube to urge the pistons out of the ends of the pressure tube against the ends of the outer tube to create longitudinal tension in the tubular wall of the outer tube and hoop tension in the tubular walls of the pressure tube whereby tension in the outer tube counteracts the compression forces on the column. The pressurized means may comprise an external pneumatic or hydraulic pump connected to the inside of the pressure tube to pressurize it, or it may comprise adjusting means between at least one end of the outer tube and its corresponding piston. Adjusting the distance between the end of the outer tube and its piston to move the piston into or out of the end of the pressure tube pressurizes or lowers the pressure in the pressure tube.

In the first exemplary embodiment, especially FIGS. 1 and 2, the adjusting means 40 comprises a threaded opening 41 through end member 13. Screw 42 is threaded into opening 41, and one end lies in seat 43 of piston 32. The other end of screw 42 extends to the outside of end member 13, and a head 44 is provided to allow for ease of turning the screw. By turning the screw in one direction, it will move to the right (FIG. 1) thereby moving piston 32 to the right and pressurizing the inside of pressure tube 20. Rotating the screw in the opposite direction allows piston 32 to move to the left thereby releasing the pressure in the pressure tube. Although a corresponding adjusting mechanism through end 12 could be used to adjust piston 31, and there may be situations where such a system would be convenient, a single adjusting mechanism decreases the number of parts necessary.

Figure 9:
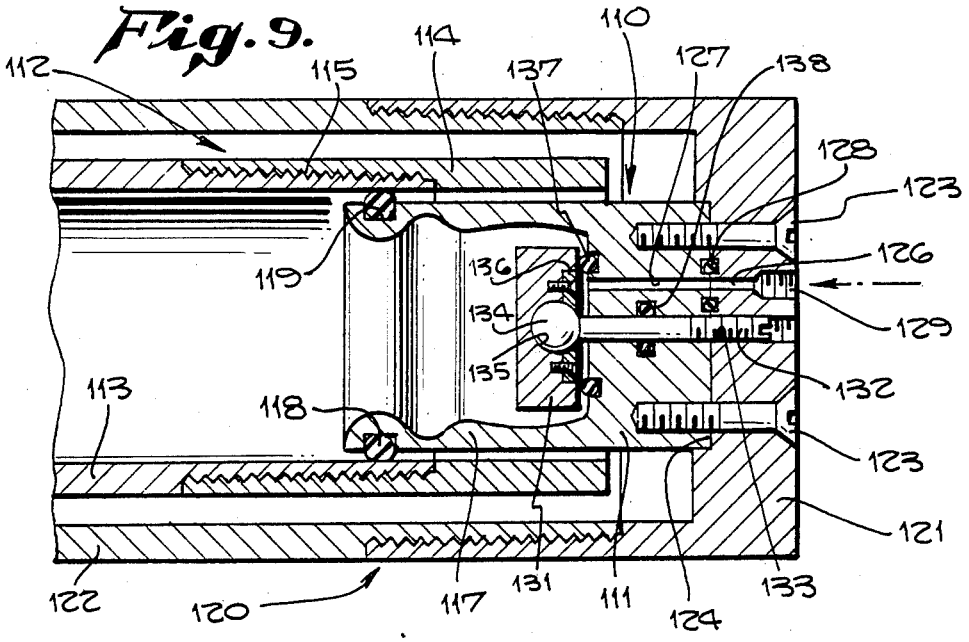
FIG. 9 is a sectional view of another embodiment for the end of the structural member of the present invention.

In the exemplary embodiment of FIGS. 1 and 2, screw 42 has a head 44. This permits either hand tightening of the screw or further tightening using a tool. Thus, it is useful for demonstration projects. In actual use as a column, it would be desirable not to have anything projecting outward from the end of end member 13. Therefore, the head would be replaced with a slot or other drive recessed somewhat into end member 13.

b. The Piston Modification: The piston may be modified as shown in the embodiment of FIG. 9. Piston 110 has a base 111 corresponding in shape to the shape of pressure tube 112. Pressure tube 112 may have its major portion 113 formed of lightweight, low modulus of elasticity material such as aluminum with an end member 114 threaded at 115 thereto. The end member is formed of a higher modulus of elasticity material such as steel, and because its short length, weight per length is not as crucial. Alternatively, a steel band or a band of high tensile strength fiber could also surround the end of pressure tube 112. The piston 110 has a base 111 and a generally hollow columnar portion 117 extending from the base. O-ring 118 is mounted in a groove 119 on the outside face of columnar section 117 and acts as sealing means for closing the space between pressure tube 112 and columnar portion 117. When the inside of pressure tube 112 is pressurized, the pressure will act radially on pressure tube 112 to increase its diameter. The pressure will also act radially on the inside portion of columnar member 117 to cause it to flare radially outward to maintain the seal between the pressure tube and the piston.

Rather than having the piston axially movable as in FIGS. 1 and 2, the pressure tube could be pressurized by means of an external pressure source. In the embodiment of FIG. 9, piston 110 is held against end wall 121 of outer tube 120 by suitable fasteners such as screws 123. Piston 110 may be lodged within seat 124. Conduit 126 passes through end member 121, and it is aligned with conduit 127 through base 111 of piston 110. An O-ring 128 around the mating ends of conduits 126 and 127 between the piston and the end member seals the conduits.

To pressurize pressure tube 112, a two-way valve is connected at opening 129, which communicates with conduit 126. Then vacuum pump is connected at opening 129, and the air is evacuated from inside the pressure tube. The valve next admits hydraulic fluid or other pressurizing medium under pressure through the conduit into the pressure tube. When the desired pressure is attained, cap 131 is moved to the right to cover and seal conduit 127. The movement is accomplished by means of partially threaded shaft 132 sealed at 138, the threaded portion of which mates into a threaded opening 133 through end member 121. The remainder of shaft 132 extends through base 111 and terminates in a ball portion 134 that mates into a corresponding opening 135 in cap 131. Ring 136 secures the ball end 134 in opening 135. As shaft 132 is rotated and cap 131 moves to the right (FIG. 9) the cap engages O-ring 137. The connection between the shaft and the cap permits the shaft to rotate without rotating the cap so that the cap will not rotate against the O-ring causing wear. Shaft 132 also has an O-ring seal to prevent pressurized fluid from leaking back through the shaft 4.

c. The Bellows Embodiment: The resilient means may also comprise a bellows axially aligned with the pressure tube and attached to the end member of the outer tube. Referring to the second exemplary embodiment and FIG. 5, the end member 73 has a recessed shoulder 74 and a more recessed shoulder 75 interconnected by incline 76. One end of bellows 84 receives recessed shoulder 75, and the bellows is welded at 77 along incline 76. The adjacent end of pressure tube 79 is welded at 82 to shoulder 81 of sleeve 80. The other end of bellows 84 is welded at 83 to the other side of shoulder 81 of sleeve 80.

The material and configuration of bellows 84 is chosen to be strong enough to resist deformation under the high pressure forces while retaining its axial resiliency so that compression from the end member will not be transmitted to the pressure tube 79. As with the first embodiment, and although not shown in FIG. 5, pressure tube 79 could be wound with high tensile strength fiber, and it is conceivable that the bellows could also incorporate such material especially due to the materials unidirectional tensile strength which could resist the pressure in hoop tension but would not contribute to resisting compressive loads.

Figure 6:
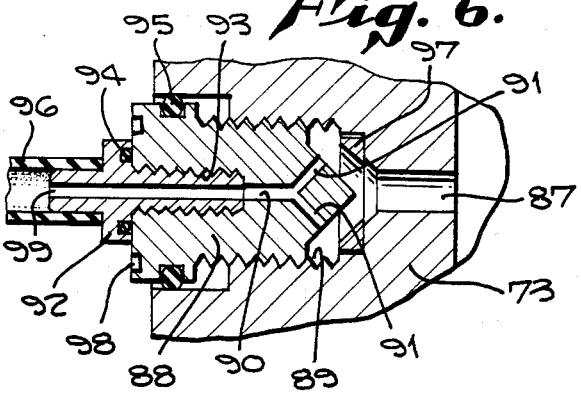
FIG. 6 is a detailed section taken through plane VI—VI of FIG. 5 showing the details of the valve for filling and pressurizing the pressure tube.

Pressurization of the pressure tube takes place as follows. An opening is provided through end member 73 for adding fluid therethrough. As shown in FIG. 6, opening 87 extends through end member 73. At the outside end of end member 73, opening 87 widens to threaded bore 89 into which sits plug 88 sealed at 95. There is an aperture 90 through plug 88. Aligned with aperture 90 is a bore 93 into which connector 92, sealed at 94, is threaded. An aperture 99 through connector 92 is aligned with aperture 90. After subjecting the pressure tube to hard vacuum to eliminate bubbles, pressurizing fluid such as gas, hydraulic fluid or other fluid is fed through removeable hose 96, which is attached to connector 92. The fluid flows through apertures 99 and 90, and aperture 90 opens into two or more tubes 91 to carry the fluid into opening 87 and into bellows 84 and pressure tube 79. O-rings 94 and 96 helps prevent leakage during pressurization.

Figure 7:
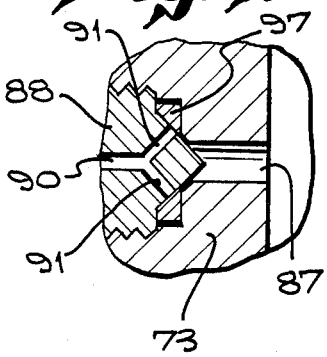
FIG. 7 shows the valve closed.

While the fluid in tube 96 is still under pressure, plug 88 is rotated to cause it to move to the right until it seats in the position shown in FIG. 7. The area of plug 88 adjacent tubes 91 contacts seats 97 thereby effectively closing the inside of the tube from the environment and maintaining the pressure therein. The seat 97 is preferably of a material softer than the plug (e.g. copper) to assist in creating a perfect seal. Alternatively, the seat material could be mounted around the ends of tubes 91, and closure would be caused by the material seating against the wall of end member 73.

Figure 5:
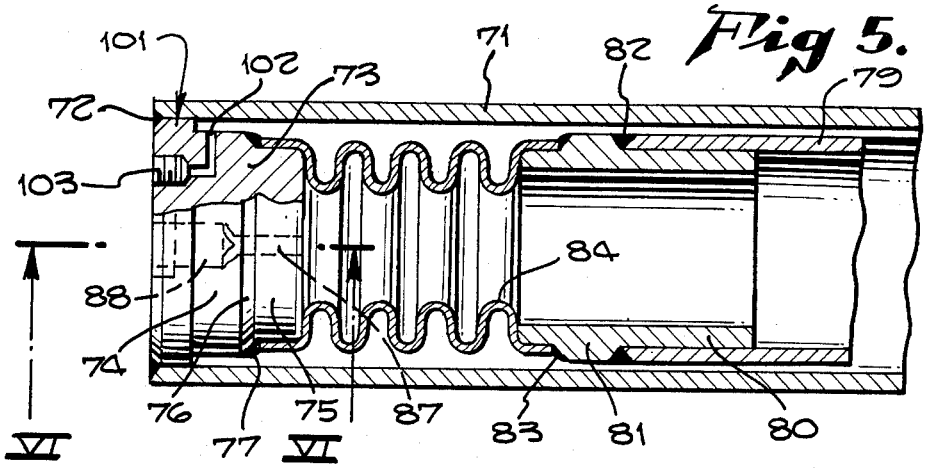
FIG. 5 is a side view, partially in section of another embodiment of the structural member of the present invention with a bellows replacing the piston.

After pressurization connector 92 is removed so that the end of the plug is flush with the end member 73 (FIG. 5). Connector 92 may be hex-shaped to assist in inserting and withdrawing the connector from bore 93. Plug 88 may be provided with recesses such as those shown in 98 for insertion of a tool for rotating plug 88.

The end member, bellows, sleeve arrangement may be identical at the other end of the structural member except that the presurizing structure would not be necessary.

Although the bellows may be provided at both ends of the pressure tube, a single bellows could be used at one end if it allowed sufficient travel. The pressure tube 79 can be split into two or more section interconnected by intermediate bellows or some other resilient means. One could also have a similar variation with the piston arrangement of the embodiment of FIGS. 1 and 2. There, the single pressure tube is replaced by two or more pressure tubes. The end of the tubes adjacent the end of the structural member is closed, but all other pressure tube ends are open. Adjacent pressure tubes are be connected by a piston such as shown at 30A. With the threaded member method of pressurizing the pressure tube, the closed end wall of one end tube is pushed inward. Because the pressure tube freely moves on its piston, there are practically no compressive loads on the pressure tube. Movement of the piston into a first pressure tube pressurizes that tube. The adjacent tube then reaches equilibrium with the first pressurized tube as the connecting piston moved between the two pressure tubes. If the pressure tubes are pressurized by adding internal pressure by injection of a fluid, the movement of the pistons between the pressure tubes also equalizes the pressure in the tubes. One may interchange much of the valve and pressurizing structure detailed in FIGS. 6 and 9 with each other.

Because some of the structural members may be mounted in critical locations, leak detection means may be provided to detect loss of fluid from the pressure tube, which would collect between the pressure and outer tubes. The leak detection means 101 of the present embodiment comprises a tube 102 which terminates in orifice 103. There may be a window closing the orifice 103. Fluid that might leak from the pressure tube or the bellows would migrate to tube 102 and could be seen in orifice 103. There may also be an indicator chemical in orifice 103 that would change color upon detection of the fluid. Alternatively, there may be electronic sensors between the tubes that could sense the presence of leaked fluid.

The unitary fluid can be replaced by composites for further weight reduction. For example hollow titanium or other metal spheres 18 (FIG. 2) may fill the tube. These spheres could range in size from a maximum outside diameter almost equal to the inside diameter of the pressure tube to very much smaller spheres to achieve a desired packing density. A combination of small and large spheres may also prove to be the optimum. The thickness of the sphere wall will have to be calculated to withstand the large pressure forces. As long as the thickness is not too great and a sphere is lighter than its equal weight of displaced fluid, the use of spheres will reduce the weight of the structural member.

Glass microspheres may also prove useful in weight reduction. Because of their small diameter, the glass shell can be thin without causing collapse of the microspheres when pressure is applied. There may also be foam plastics which will be sufficiently strong to resist the large pressure forces.

Figure 10:
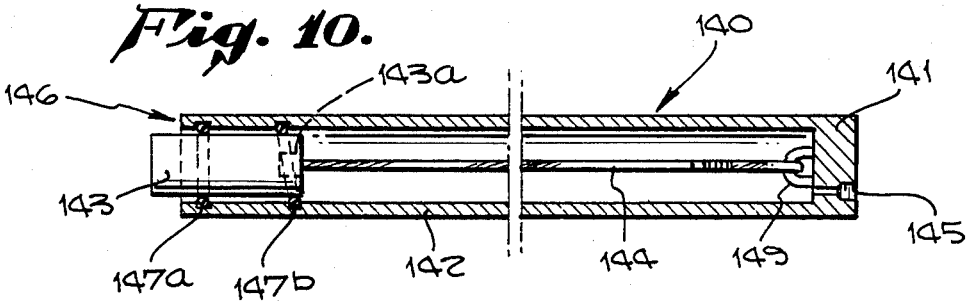
FIG. 10 is a side view partially in section of another exemplary embodiment of the structural member of the present invention.

It is contemplated that the foam plastic, glass microspheres and the hollow metal spheres may be combined with each other. Each one, whether used alone or in combination with others, would most likely be in a fluid. The glass microspheres, because of the small particle size, approach a fluid, however, so that it may be unnecessary to use an additional liquid with them. Although gases are contemplated as potential fluids, they are not as safe as liquids. At the high pressures that will be used, the gases will be very compressed such that if the pressure tube fails, there may be a explosion from the rapidly expanding gas. A liquid compresses much less. The liquid will expand only slightly if the tube fails so that there will not be an explosion.

d. The Piston-Cable Embodiment: As previously set forth, it is important that the tube under pressure be subjected to practically no compressive loading. In the embodiments of FIGS. 1, 2, and 5, the inner pressure tube was supported by an outer tube. In the embodiment of FIG. 10, the two ends of cable 144 are attached to piston 143 at connector **143*a* at one end 146 of tube 140. Cable 144 attaches to the other end 141 of tube 140 through ring 149. The fluid within tube 140 is prevented from passing between piston 143 and tubular walls 142 by O-rings 147*a* and 147*b*. Other end systems, such as those of other embodiments, could be used in FIG. 10. The seal at O-rings 147 must permit freedom of movement between piston 143 and tubular walls 142 so that when a load is applied in compression on piston 143 and end 141, tubular walls 142 will not be in axial compression. Means for pressurizing the inside of tube 140 are shown schematically at 145 and may be any suitable hydraulic valving and filling system such as that shown in FIGS. 6, 7 and 9**.

In the "Background of the Invention," the effectiveness of suspension structures was discussed. This embodiment conceptually approximates the suspension.

Whereas in a typical suspension, the cables are external and are tensioned with respect to the ground, the cable in the embodiment of FIG. 10 is internal and tensioned with respect to the structure itself.

It may also be possible to eliminate the aforementioned phenomenon of increased pressure force on the bottom wall caused by its lengthening. In FIG. 10, O-ring 147*b* in phantom is at a slight angle to the vertical. The angle is accentuated for the drawing. As previously discussed, when a vertical force is applied to beam 140 in its horizontal orientation, the bottom portion of tube 140 will be made somewhat longer than the top portion. However, the bottom portion subjected to pressure begins somewhat shorter because of the angle of the O-ring. Where two pistons are used, the angle of each O-ring may be less as each contributes to length changes. The angles may be determined by the maximum possible load such that the angle can compensate for the phenomenon.

Figure 13:
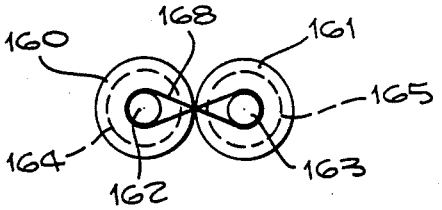
FIG. 13 is a schematic view showing how two structural members could be coupled together for relative rotation of the pistons with respect to each other.

FIG. 13 is a schematic showing how two adjacent tubes could be used to compensate for different loads. Assume that each tube 160, 161 has its O-ring oriented similar to that shown in FIG. 10. There would be a slight bulging upward of the tubes if they were not subjected to load. Of course, the weight of the tube would tend to counteract that bulge. The pistons 164, 165 of the two tubes 160, 161 in FIG. 13 are connected together by a looping connector cable 166 over pulleys 162 and 163 so that the pre-bulge can be adjusted. If the beam that comprised tubes 160 and 161 were being subjected to vertically upward load, the piston could be counter-rotated with each other such that the pre-bulge would be of sufficient magnitude and in the proper direction to resist the anticipated load. In a panel, adjacent tubes may be coupled, or the coupling may be between every three or four tubes. Likewise, if two pistons are used in each tube, one or both pistons can be rotated. It is also contemplated that the tubes themselves may rotate. The pistons in FIG. 1 and 9 can also be made to rotate, or part of piston 110 in FIG. 9 can be adapted for rotation.

e. Characteristics of Some Parts: If the pressure tube comprises a liner with a high tensile strength fiber wrap (e.g. metal liner with Kevlar circumferental wrap), the liner should have a modulus of elasticity less than or equal to the modulus of elasticity of the fiber wrap, or the liner will fail before the fiber fails. The modulus of elasticity of Kevlar is approximately $11\times10^6$ psi, but the modulus of steel is greater. 7075 aluminum alloy, however, has a modulus of elasticity of $10.3\times10^6$ psi with a density of 0.101 lbs/cu.in. Therefore, with a Kevlar wrap, 7075 aluminum alloy ideally meets the requirement of having a modulus of elasticity less than or equal to that of Kevlar with a low density for weight reduction.

Because the outer tube will be in pretension along its longitudinal axis, the outer tube may include longitudinal high strength fibers, which further reduces weight. The end of the outer tube may also be of different material than the center. In FIG. 9, the end portion 121 of outer tube 120 is made of a stronger material than the remainder 122 of the outer tube. Although shown as threaded together, cylindrical portion 122 could be fastened to end member 121 in any desirable manner. If lower tensile strength materials are used in end member 121, the thickness of the end member may have to be adjusted to increase total strength.

The fluid pressure which is resisted by the cylindrical wall of the pressure tube acts either on the end walls of the outer tube through piston 31 (FIGS. 1 and 2), directly as in FIG. 5 or through some of the other arrangements discussed, or the pressure acts on piston 143 and end 141 (FIG. 10). The force puts the tubular walls of the outer member or the cable in tension. As a column, the structural member could support at least a load up to its pre-tention with no effective compressive load on the outer tube. Likewise, cable 144 is does not support a column load and none of the compressive load is transmitted in axial compression to the tube 140.

Figure 4:
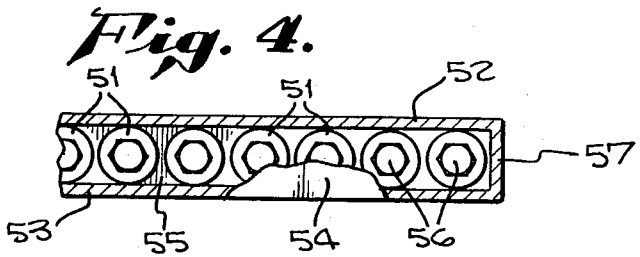
FIG. 4 shows a plurality of the pressure tubes in parallel with a pair of plates replacing the outer tube to form a flat plate structure that resists transverse or edge loading.
Figure 11:
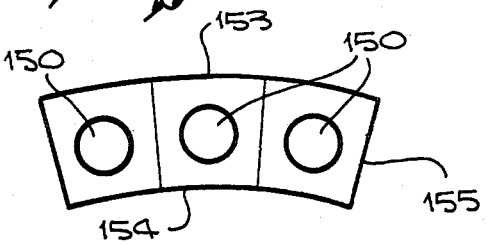
FIGS. 11 and 12 show how the structural members may be connected together.
Figure 12:
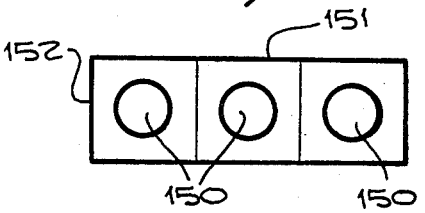

As previously discussed in brief and as more fully discussed hereinafter, the preloading of the outer tube also dramatically enhances its benefits as a beam. FIGS. 4, 11, 12 and 13 are presented to show applications of the structural member as a beam. In FIG. 4 a plurality of pressure tubes are parallel to each other in a flat plate with all of the pressure tubes 51 being in a plane, but their placement can be modifled to achieve desired results. In FIGS. 11 and 12, rather than having all of the pressure tubes under one plate, pressure tubes 150 are each mounted within an outer tube that is not round. For example, in FIG. 12, each outer tube is a square having sidewalls 151 and 152. The square fit allows for easier connecting between adjacent members as by welding or other similar processes. In FIG. 12, moreover, all of the structural members need not be in the same plane. For a beam, it may be desirable to orient them into an I or H or some other shape for a desired surface. In FIG. 11, the outer tubes are somewhat trapezoidal with straight sides 155 and curved top and bottom walls 153 and 154. By modifying the dimension and shape of the walls of the outer tube, the members could have a curved beam surface. Members could even be placed adjacent each other to form a cylinder with very effective walls for pressure or vacuum chambers.

In the plate shown in FIG. 4, the pressure tube has two plates 52 and 53 on the top and bottom of the pressure tubes 51. The top and bottom plates are connected by end walls 54 and 55. The end walls perform the same function as the end walls 12 and 13 in FIGS. 1 and 2. That is, they are pushed by fluid pressure to prestress plates 52 and 53. In the embodiment of FIG. 4, the pressurizing means is the same as that shown in FIGS. 1 and 2, and head 56 of the screw (corresponding to head 44 in FIG. 1) extends beyond end wall 54. A sidewall 57 may also be provided. The bottom wall may be eliminated keeping in mind that there will be the need for additional shoring of the end walls to the single plate to resist the shear stress.

The plate structures would be extremely useful for long, lightweight portable bridges for certain types of loading it may be desirable to have two layers of tubes with the tubes of one layer perpendicular and then displaced from the tubes of the other layer.

2. Characteristics of the Invention:

a. As a Column: Table 1, which follows, describes the parameters for an exemplary structural member of the two-tube design functioning as a column. The values listed in Table 1 were derived from the following equations.

$$P_r = St/r_i \quad (1)$$

Where S=stress (psi), t=tube wall thickness (in), $r_i$=radius of pressure tube 20 (in), and $P_r$=pressure within tube 20 (psi).

The load, $$L_{(lbs)}=P_r\pi(r_i)^2 \quad (2)$$

The tension in outer tube 11 (lbs):

$$S=P/A=L/A=L/\pi(r_o^2-r_i^2). \quad (3)$$

where $r_o$ is the outside radius of tube 11 (dimension a in FIG. 3). Therefore $$r_o=[(L/S)+(r_i^2)]^{\frac{1}{2}} \quad (4)$$

The slenderness ratio (l/k) (where l is the tube length (in) and k=radius of gyration) of a tube:

$$l/k=2(l)/(r_o^2+r_i^2). \quad (5)$$

Euler approximated maximum loads for columns of different materials. For slenderness ratios between 50 and 150, $$P/A=120{,}000-400\ (l/k), \quad (6)$$

assuming 100 ksi stress material. If l/k is greater than 150, $$P/A=45\ E/(l/k)^2 \quad (7)$$

E is the modulus of elasticity (psi).

The slenderness ratio of a pair of concentric cylinders equals:

$$\frac{1}{\frac{1}{(1/r_i)}+\frac{1}{(1/r_o)}} \quad (8)$$

The slenderness ratio for a solid cylinder equals $$2(l/r) \quad (9)$$

The efficiency (e) of the system is defined as the ratio of the load of the tube piston system versus the maximum load on a solid cylinder at a given slenderness ratio times the ratio of the weight of the solid cylinder to the weight of the tube-piston system:

$$e=L_P/L_C\times W_C/W_P \quad (10)$$

where $L_C$ and $L_P$ are the load on the piston-shell system and the single cylinder respectively, and $W_C$ and $W_P$ are the weight of the cylinder and the shells and piston respectively.

Assuming that the outside diameter is 1.02 in (25.8 mm), table 1 sets forth the following values for a sample system values.

S, a given, is the longitudinal stress on the outer tube;

$P_r$, the pressure within the pressure tube is calculated from Equation (1);

L, the load on the piston, is calculated using Equation (2);

l, a given, is the column length;

$L_C$, the maximum load that a solid cylinder of length l can support, is calculated from Equations (6) and (7); and e, the efficiency, is calculated using Equation (10).

TABLE 1

| S ($10^3$ psi) | $P_r$ ($10^3$ psi) | L ($10^3$ lbs) | l (ft) | $L_C$ ($10^3$ lbs) | e |
|---|---|---|---|---|---|
| 100 | 6.23 | 2.44 | 2 | 66.6 | 0.2 |
| 110 | 6.86 | 2.68 | 4 | 30.6 | 0.5 |
| 120 | 7.48 | 2.68 | 6 | 13.6 | 1.2 |
| 130 | 8.10 | 3.17 | 8 | 7.64 | 2.1 |
| 140 | 8.73 | 3.42 | 10 | 4.89 | 3.3 |
| 150 | 9.35 | 3.66 | 12 | 3.40 | 4.7 |
| 160 | 9.97 | 3.90 | 14 | 2.50 | 6.4 |
| 170 | 10.6 | 4.14 | 16 | 1.91 | 8.4 |
| 180 | 11.2 | 4.29 | 18 | 1.51 | 10.6 |
| 190 | 11.8 | 4.64 | 20 | 1.22 | 13.1 |
| 200 | 12.5 | 4.88 | 22 | 1.01 | 15.9 |

Note how the maximum load $L_c$ on a conventional cylinder deteriorates rapidly as the length l increases. Note also how quickly the efficiency e of the beam of the present invention as defined in Equation 10 increases at higher lengths.

The following demonstrates what happens during active loading of another exemplary column. The dimensions in inches are taken from FIG. 3. a=0.5703; f=0.065; b=0.3762; and e=0.0249. Outer tube 11 is 304 stainless steel having a 35,000 psi yield strength. Inner tube 21 is formed of AM 350 having about 183,000 psi yield strength and 202,000 psi ultimate strength. Both materials have a modulus of elasticity of $E=29\times10^6$ psi.

Calculating the maximum strain on the inner tube 21, $$P_r=St/(r_1+t/2) \quad (11)$$

where $r_1$ is the outside radius of the inner tube (dimension b) and t is the tube thickness (dimension e).

$$P_r=\frac{183{,}000(.0249)}{.3762-(.0249/2)}=1.26\times10^5\ \text{psi}$$

The piston load $$L=P_r\pi(r_i-t)^2 \quad (12)$$

$$=P_r\pi(.3762-.0249)^2=4{,}872\ \text{lbs}=2{,}210\ \text{kg}.$$

The hoop strain $\epsilon=S/E=183{,}000/29{,}000{,}000=0.00633$ in/in.

$$F_o=K_o\delta_o \quad (13)$$

$$F_i=K_i\delta_i \quad (14)$$

where $K_o$, $K_i$=effective spring constants;

$\delta_o$, $\delta_i$=tube, piston compression; and $F_o$, $F_i$=outer tube, center tube preload.

The internal circumference $C=[2r-(t/2)]=2.324$ in.

The change in circumference=C=C=0.0147 in.

When pressurized to yield strength, the circumference becomes 2.339 in. The cross-sectional area, which is constant during pressurization is:

$$A=\pi[r^2-(r-t)^2]=0.0569\ \text{in.}$$

By various substitutions:

$$r=\frac{1}{2C}[(C^2/\pi)+A] \quad (15)$$

$r_o$=0.4844 in $r_i = r_o - t = 0.3601$ in

The inner cylinder piston travels from strain and from the 12,600 psi pressure as follows:

The change of length due to strain is:

$$l = l_o[l - (r_i^2/r_y^2)] = 3.72 \text{ in}$$

The piston travel due to fluid compressibility may be calculated from the *Fluid Pressure Handbook*, which gives volume reduction of 4 MIL H5606 hydraulic oil as function of pressure. For a pressure of 12,600 psi, volume reduction is approximately 4.9%. Therefore, the piston travel due to fluid compressibility $= (l - \Delta l)(0.049) = 3.57$ in.

Thus, the total piston travel at yield is $\Delta l_{TOT} = 3.72 + 3.57 = 7.29$ in $= 185$ mm The spring constant $K_i$ of the piston/tube assembly can be computed.

$$K_i = P_i(A)/\Delta l_{TOT} \quad (16)$$

$$= 7.29 = 668 \text{ lbs/in} = 11{,}929 \text{ kg/m}$$

The "effective" modulus of elasticity $E_e$ can be determined from its definition:

$$E_e = Ll_o/A_o(\Delta l_{TOT}) = 2.57 \times 10^5 \text{ psi} = 1.77 \times 10^5 \text{ kPa}$$

The outer tube has the following characteristics: Its maximum stress based on the ultimate stress of the inner tube is:

$$S_o = L/A_o = L/\pi[r_o^2 - (r_o - t_o)^2] \quad (17)$$

$$= 2.22 \times 10^4 \text{ psi} = 1.53 \times 10^6 \text{ kPa}$$

The maximum strain $\delta_o = S_o/E_o = 7.66 \times 10^{-4}$ $$\Delta l_o = l_o E_o = 6.48 \times 10^{-2} \text{ in} = 1.65 \text{ mm}$$

The spring constant of the outer tube:

$$K_o = 4872/(6.48 \times 10^{-2}) = 7.52 \times 10^4 \text{ lbs/in} = 1.34 \times 10^6 \text{ kg/m.}$$

The overall system performance can be analyzed as follows. First, bolt 42 can deflect piston 31 almost to its maximum. In the example given, the piston would move approximately 7.22 in. The outer tube is now prestressed in tension to about 4800 lbs and stretched within its elastic limit 0.064 in. The assembly can then be loaded as a column up to the full amount of the prestress without any tendency to buckle. It is also fortunate that the spring constant for the inner tube is less than one percent that of the spring constant of the outer tube. Therefore, there is no change in the resisting force. At full external column load, only an insignificant increase in internal pressure will result.

b. Structural Member as a Beam: The structural member of the present invention is also extremely useful as a beam. Visualize again a typical beam horizontal and freely suspended on two supports. There will be a comparison between the structural member of the present invention with an outside diameter of 0.824 in (18.5 mm) and a titanium tube of the same outside diameter and a tube thickness such that the tube has the same mass to length ratio as the structure member. Initially, the calculations disregard the effect caused by the lower part of the beam being longer than the upper part.

A parabolic suspension is one of the most effective ways of supporting a load. A flexible cable assumes approximately a parabolic shape if it supports a generally uniform load over its span. A suspension bridge is a typical application. Where the load is carried in the cable itself so that the weight distribution is a function of the cable length rather than the span length, the cable is in the shape of a catenary. The following discussion will use the mathematics of a parabolic suspension for reasons set forth hereinafter.

In a cable of length l having a uniformly distributed weight w and a span of a, if the tension T is known, the deflection can be calculated.

$$T = (\tfrac{1}{2})wa[l + (a^2/16d^2)] \quad (18)$$

Calculating for d, $$d = \frac{a}{4\left[\frac{2T}{W} - 1\right]^{\frac{1}{2}}} \quad (19)$$

In a parabolic suspension, the cable length l can be approximated by:

$$l = a[l + 8/3(d/a)^2 - 32/5(d/a)^4 + 256/7(d/a)^6 \ldots] \quad (20)$$

Assume that the structural member has a diameter of 0.824 in (20.9 mm) and has an inside tube, an outside tube, hydraulic fluid in the inner tube, and hollow titanium spheres displacing a portion of the fluid totaling 0.23 lbs/ft (0.34 kg/m). Tension T is 2410 lbs (1095 kg), developed from pretensioning by pressurizing the inner shell.

Table 2 represents calculations for the deflection of the inner-outer tubes structural member for various lengths and at various loadings. Item a is the span length, $d_o$ is the deflection of an unloaded beam, and $d_{50}$ is the deflection assuming a uniform 50 lbs/ft loading. The midpoint tension without a load is almost constant 2410 lbs.

TABLE 2

| a | $d_o$ (in) | $d_{50}$ (in) |
|---|---|---|
| 10 | .014 | 3.14 |
| 15 | .032 | 7.12 |
| 20 | .057 | 12.8 |
| 25 | .090 | 20.2 |
| 30 | .129 | 29.6 |
| 35 | .176 | 41.1 |
| 40 | .230 | 55.0 |
| 45 | .291 | 71.7 |
| 50 | .359 | 91.6 |
| 60 | .517 | 144 |
| 70 | .704 | 223 |
| 80 | .919 | 362 |
| 90 | 1.16 | |
| 100 | 1.44 | |
| 110 | 1.74 | |
| 120 | 2.07 | |
| 130 | 2.43 | |
| 140 | 2.82 | |
| 150 | 3.23 | |
| 160 | 3.68 | |
| 170 | 4.15 | |

Figure 8:
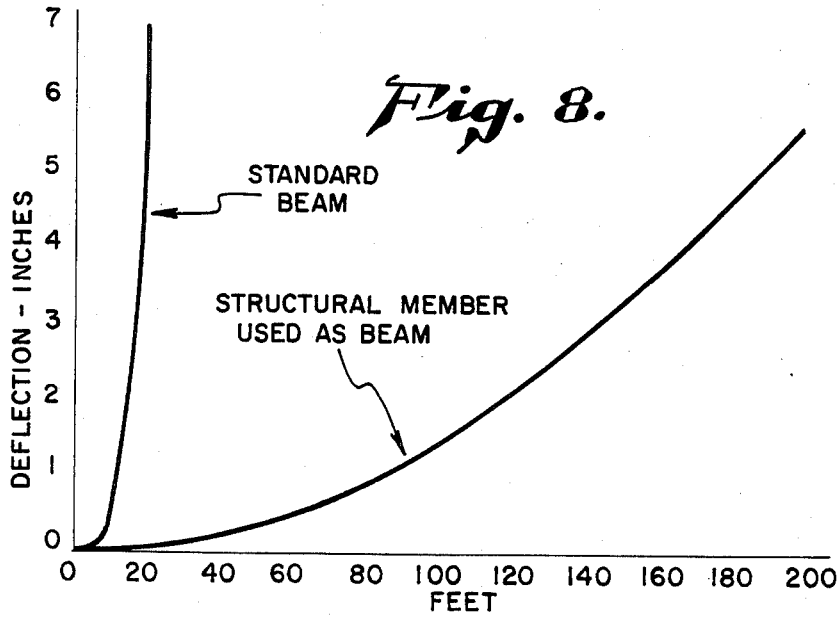
FIG. 8 is a graph showing the anticipated deflection of a freely supported horizontal steel rod and of the present structural member 0.82 in (21 mm) in outside diameter as a function of rod length.

The dramatic nature of the lack of deflection of the present structural member used as a beam can best be related when compared to a standard beam. In FIG. 8, the curve marked "standard beam" is a plot of the expected deflection of a titanium cylinder of the same outside diameter with an inside diameter chosen such that the weight per unit length equals the weight per unit length of the inner-outer tube structural member of the present invention. The deflection of such a standard beam:

$$d = 5/384\ (wa^4/EI) \tag{21}$$

where E is the modulus of elasticity, which in the case of titanium is about $1.6\times10^7$ psi; and I is the moment of inertia, which of a tube about its longitudinal axis equals $(r_o^4 - r_i^4)/64$.

For a 50 ft (15.2 m) span the structural member of the present invention would be expected to deflect approximately 0.36 in (9.1 mm), but a standard beam of the same span would be expected to deflect approximately 18.8 ft (5.7 m). Thus, the deflection of a standard beam is more than 600 times the deflection of the beam of the present invention.

The only way that the deflection of a standard beam can be decreased is by increasing the moment of inertia. Assuming the same material and the same weight per length, the moment can be increased only slightly, however. If a material with a higher modulus of elasticity is used, deflection can be decreased, but there are limits to moduli of materials, and one could only hope for an approximate doubling of the modulus.

It is as if for the 50 ft span in the present invention, the modulus of elasticity of the beam material were over 600 times greater than the modulus of material in a standard beam. The "effective modulus" of the structural member of the present invention is even greater as the length of the beam is increased. A standard beam 75 feet in length would deflect approximately 1400 times the beam of the present invention except the standard beam would have failed. FIG. 8 shows these results graphically.

Many of the above calculations are based on the approximation of the beam assuming a parabolic shape rather than a catenary. For small deflections, the approximation is very close. With the beam that has just been discussed, up to approximately 20 ft in length, the deflection calculated using the parabolic formulas versus those using the catenary formulas are very close. At 20 ft, the parabolic deflection calculates to 5.79 in, and the catenary deflection calculates to 5.74 in. At 22 ft, however, the difference in deflection is more than an inch, the parabolic deflection calculating to 8.5 in and the catenary deflection calculating to 7.4 in. Using parabolic formulas yields conservative results, however, and the parabolic equations hold true for loaded beams.

The above discussion assumed no external loading to the beam. As Table 2 shows, the deflection at 50 lbs/ft uniformly loaded is still relatively minor. For example, a 20 ft beam loaded at 50 lbs/ft would deflect only slightly more than a foot. If this small amount of deflection is too great, two or more structural members can be used. It has been calculated that a composite panel such as that shown in FIG. 4 of a thickness of 0.83 in, a 12 in width and a 50 foot length would support a total uniform distributed load of about 37,000 lbs but would deflect only about 7 ft and weigh only about 174 lbs.

The following is an analysis of the embodiment of FIG. 10. As previously discussed, the use of composite fibers allows for very high strength-to-weight structures if force is unidirectionally in tension. The cable 144 in FIG. 10 is best made from composite fiber such as Kevlar because it will only be subjected to unidirectionally tension load.

There are many ways of fastening the cable to the end wall and to the piston. In the exemplary embodiment, assuming the cable is formed of unidirectional fibers, strains of the fiber would be clamped to clamping means on the piston and looped through eye 149 on end wall 141. From Equation 1 it will be recalled that the maximum pressure within the tube (P) equals $st/r_i$, where S is the maximum hoop stress of tube 140, T is the tube thickness and $r_i$ is the inside radius.

The cable tension (T) equals $P\pi(r_i^2 - r_c^2)$ where $r_c$ is the radius of the cable.

Using the deflection equations set forth above, through various substitutions, the deflection of the beam of FIG. 10 can be computed. It will be assumed that the tube thickness is 0.03125 in (0.794 mm) having a radius of 0.475 in (12.1 mm). It will also be assumed that the cable can withstand a maximum of stress of 200,000 psi (1,360,000 kPa).

The maximum internal pressure is calculated by the following formula:

$$P = \frac{S_c(D_f)^2 N(n_f)}{4[r_i^2 - (D_f)^2 N(n_f)/4]} \tag{22}$$

where $S_c$ = the stress in the cable, which for Kevlar is assumed to be 400,000 psi.

$D_f$ = the diameter of each individual filament of the cable.

$n_f$ = the number of filaments in each strand, and

N = the number of strands in the cable.

Therefore, if the deflection is assumed to be parabolic $$T = \frac{(S_T)t\pi}{r_i}\left(r_i^2 - \frac{n_f N(D_f)^2}{4}\right) \tag{23}$$

Where $S_T$ is the allowable stress in the tube wall, which could be, for example, 200,000 psi.

Therefore, the deflection $$d = \frac{L}{4[(2T/wL)^2 - 1]^{\frac{1}{2}}} \tag{24}$$

Where

L = span, and w = weight per unit length.

If the equations are used for calculating the number of strands necessary to achieve a particular result, N should be a whole even number.

Next, it will be determined how the increased pressure force acting on the side of the pressure tube with the greater radius of curvature affects the beam deflection. The following equations are the worst case example. It assumes that the tube is square and supports no load in shear in its sidewalls. Using this calculation tends to overstate the additional deflection and yields conservative results. The additional force (F) can be derived from the following equation:

$$F = (8\,P\,r_r^2)\cos^{-1}\left(\frac{\left[\frac{d^2 + (K/4)^2}{2d}\right]^2 \frac{K^2}{4}}{d^2 + K^2/4}\right)^{\frac{1}{2}} \quad (25)$$

Where $K = 2(r^2 - c^2)^{\frac{1}{2}}$ r = radius of curvature, c = distance between the center of curvature and a chord connecting the support points of the beam.

The increased pressure force is applied uniformly. Likewise, in Equation 24, the term wL is presumed to be a load uniformly spaced over the length of the tube. Thus, these two forces combine. Therefore, Equation 26 adds the additional force F to the force contributed by loading.

$$d = \frac{L}{4[(2T/(wL + F))^2 - 1]^{\frac{1}{2}}} \quad (26)$$

F can either be positive or negative. Thus, if the member is pressurized when it is deflected downward because of gravity, if the beam were being used to resist a vertically upward force, F would be negative.

In order to compute the actual deflection, a nominal deflection is first assumed. F is then computed utilizing Equation 25. F is then used to compute d, the deflection, in Equation 26. Alternatively, a maximum deflection may be acceptable, and the equations may be used to determine the amount of weight per unit length, w, that the column can support. Using Equation 25 to solve for F, Equation 26 can then be solved for w.

For particular parameters of the structural member, F may be somewhat greater than, equal to or somewhat less than wL.

Therefore, it can be seen that not only is the present invention a load bearing member capable of supporting large weights as a beam or as a column, it is also an ultra-stiff structure for those uses requiring them. Both the stiffness and extremely high strength-to-weight ratio suggest many applications. For example, in construction, the member could be used as a long span building beam or in load carrying walls. It could also be used as load bearing members in very light bridges and crane booms. In aerospace applications, the beam-column has applications in the construction of space vehicles where high strength-to-weight and high stiffness to weight. The present member could also be used where very stiff structures are necessary for astronomy or other instrumentation. Airplanes could use such supports for the long wing span. This is particularly important in gliders where long wing spans of low weight are needed. Wherever there is a vibratory flutter problem, the present member would help alleviate it. For example, turbine shafts could be stiffened using a member.

A lightweight bridge could be used by fire fighters for portable rescue ladders or portable building-to-building emergency bridges. Light poles for street lights, billboards, flag poles and even sailboat masts could utilize the member. Where stiffness is an attribute in sporting equipment such as tennis rackets or non-sag high jump and pole vault bars, the member would find use. Even in the automotive field, panels could be constructed using the member, they could be used to stiffen the vehicle frame, and the bumper and the attaching structure of the bumper could utilize the members to minimize damage in a collision. Clearly there will also be other uses.

Thus, the structural member of the present invention has been described which meets the objects set forth for it as well as other implied objects set forth in the specification. Although exemplary embodiments have been discussed, the scope of the invention is to be considered that which is set forth in the claims and their equivalence.

I claim:

1. A structural member comprising:

(a) an outer member of generally rigid material having a closure member fixed at each end of the outer member;

(b) a pressure tube having an inside length very much greater than its inside diameter;

(c) end members for sealing the ends of the pressure tube, at least one end member being movable with respect to the pressure tube;

(d) mounting means between the outer member and the pressure tube for mounting the pressure tube within the outer member, the end members contacting the closure members for force transmission, and the pressure tube being out of force transmission contact with the outer member;

(e) pressurizing means for pressurizing the inside of the pressure tube to urge the end members against the closure member and to radially load the pressure tube; and (f) free acting means between the end members and the pressure tube permitting at least one end member to move freely in the pressure tube for limiting the axial load on the pressure tube from the end members.

2. The structural member of claim 1 further comprising an O-ring between the walls of the pressure tube and at least one movable end member to permit movement of the end member under the pressure forces within the pressure tube without subjecting the walls of the pressure tube to appreciable axial stress, the O-ring being mounted at an oblique angle to the perpendicular to the axis of the pressure tube to provide a shorter length for a portion of the tubular wall on one side of a plane passing through the axis of the tube in order to compensate for such portion's normally longer length under normal loaded conditions.

3. The structural member of claim 2 including means for rotating at least one end member for orienting the O-ring.

4. The structural member of claim 1 wherein the at least one movable end member includes a base and a generally hollow columnar portion integral with and extending from the base in the pressure tube, the columnar portion having an outside dimension slightly less than the inside dimension of the pressure tube, sealing means between the columnar portion and the inside of the pressure tube for sealing the space between the pressure tube and the columnar portion and permitting axial movement therebetween when the end member is subjected to internal pressure and whereby when such pressure expands the walls of the pressure tube means, it causes the columnar portion to expand outward to remain in contact with the walls of the pressure tube means.

5. The structural member of claim 4 wherein the pressure tube has a portion of lower modulus of elasticity material extending a substantial distance of the pressure tube and a portion of higher modulus of elasticity material extending from the columnar portion to the end of the pressure tube means to resist expansion of the pressure tube upon introduction of internal pressure in the pressure tube means adjacent the at least one movable end member.

6. The structural member of claim 1 wherein both end members are movable with respect to the pressure tube.

7. The structural member of claim 1 having a plurality of pressure tube means parallel to each other, the walls of the outer member comprising at least one plate extending over the plurality of pressure tube means and end walls on the plate along the ends of the pressure tube means whereby the structural member comprises a rigid plate.

8. A structural member comprising:

(a) an outer member having two opposed closure members and walls interconnecting the closure members;

(b) pressure tube means having an elongated tubular wall with a length very much greater than the inside diameter and having a fluid therein, the pressure tube means being in the outer member;

(c) mounting means at the end of the pressure tube means extending against the closure members of the outer member for permitting axial movement of the pressure tube means relative to the closure member;

(d) pressurizing means for pressurizing the fluid in the pressure tube means and for transmitting the pressure forces against the closure members of the outer member for putting the walls of the outer member in tension for prestressing them while the tubular wall of the pressure tube means is placed in hoop tension whereby the mounting means prevents the pressure tube means from being placed in axial compression from compressive loading of the outer member.

9. The structural member of claim 8 having a plurality of pressure tube means parallel to each other, the walls of the outer member comprising at least one plate extending over the plurality of pressure tube means and end walls on the plate along the ends of the pressure tube means whereby the structural member comprises a rigid plate.

10. The structural member of claim 8 wherein the pressure tube means comprises a single tube, the mounting means comprises a piston extending into one end of the single tube and extending against one closure member of the outer member, whereby when the pressure tube means is pressurized, the piston transmits a portion of the pressure forces against the closure member of the outer member.

11. The structural member of claim 10 wherein the pressurizing means comprises adjusting means extending between at least one piston and the adjacent closure member of the outer member for adjusting the position of the piston relative to the closure member and within the pressure tube means for changing the volume inside the pressure tube means for modifying the fluid pressure therein.

12. The structural member of claim 8 wherein the pressure tube means comprises a single tube, the mounting means comprises a pair of pistons extending into each end of the single tube and extending against the closure members of the outer member whereby when the pressure tube means is pressurized, the pistons transmit a portion of the pressure forces against the closure members.

13. The structural member of claim 8 wherein the inner tube means comprise a plurality of axially aligned tubes and internal pistons extending between adjacent tubes, the mounting means fixing one end of each of the two tubes adjacent the closure members of the end members in a fluid-tight relation whereby the internal piston between each adjacent tube permits axial movement of the tubes and a portion of the pressure is exerted outwardly on the closure members to pre-tension the outer member.

14. The structural member of claim 8 wherein the pressure tube means comprise a plurality of axially aligned tubes and internal pistons extending between ends of adjacent tubes, the mounting means further comprising at least one end piston between at least one of the tube ends adjacent one closure member and such closure member whereby the internal piston between each adjacent tube and the at least one end piston permits axial movement of the tubes, portion of the pressure being exerted outwardly on the closure member by the at least one end piston.

15. The structural member of claim 8 wherein the pressurizing means comprises an opening through at least one of the closure members into the pressure tube means for pressurizing the fluid therein.

16. The structural member of claim 8 wherein the mounting means comprising resilient means between at least one end of the pressure tube means and the closure member for permitting axial movement of the pressure tube means relative to the outer member.

17. The structural member of claim 8 wherein the pressure tube means comprises a plurality of axially aligned tubes, the mounting means comprising resilient means between adjacent ends of the axially aligned tubes for permitting axial movement of the axially aligned tubes relative to the outer member.

18. The structural member of claim 8 further comprising leak detection means extending through the closure member of the outer member and the space between the pressure tube means and the outer member for detection of the presence of fluid in the space.

19. The structural member of claim 8 wherein the pressure tube means comprises a leakproof liner and a winding of high tensile strength material wound circumferentially around the liner to resist hoop stress from the fluid pressure.

20. The structural member of claim 19 wherein the high tensile strength material exhibits its strength unidirectionally, the winding being such that the direction of maximum tensile strength is circumferential to the pressure tube.

21. The structural member of claim 20 wherein the modulus of elasticity of the material of the pressure tube means is no greater than the modulus of elasticity of the winding material.

22. The structural member of claim 10 wherein the piston includes a base and a generally hollow columnar portion integral with and extending from the base inside the pressure tube means, the columnar portion having an outside dimension slightly less than the inside dimension of the pressure tube means, sealing means for sealing the space between the pressure tube means and the columnar portion and for permitting axial movement therebetween whereby pressure in the pressure tube means which causes the diameter of the pressure tube means to increase also causes the columnar portion to flare outward with expansion of the diameter of the pressure tube means to maintain the seal therebetween.

23. The structural member of claim 22 wherein the base of the piston includes means for securing it to a closure member, a conduit extending through the closure member and aligned with a conduit through the base and extending into the inside of the generally hollow columnar portion for adding and pressurizing fluid in the pressure tube, a cap in the generally hollow columnar portion adjacent the opening of the conduit into the portion, and cap positioning means attached to the cap and extending through the base and the closure member for positioning of the cap to seat the cap alternatively over the opening or off the opening for sealing the conduit or permitting the conduit to be used for pressurizing the inside of the pressure tube.

24. The structural member of claim 23 wherein the cap positioning means is threaded into the closure member whereby rotation of the cap positioning means moves the cap against and away from the opening of the conduit into the generally hollow columnar portion, and connecting means between the cap and the cap positioning means for permitting rotation of the cap with respect to the cap positioning means whereby when the cap contacts the opening of the conduit into the columnar portion, continued rotation of the cap positioning means will not cause friction between the cap and the base.

25. The structural member of claim 22 wherein the sealing means in mounted at an oblique angle to the perpendicular to the axis of the pressure tube means.

26. The structural member of claim 25 including means for rotating the at least part of the piston for orienting the O-ring.

27. A structural member comprising an outer shell having fixed closure members at the ends of the outer shell, and an interconnecting wall connecting the closure members, an elongated pressure tube assembly in the outer shell having a length very much greater than the inside diameter, at least one piston extending into a corresponding number of ends of the pressure tube assembly and movable with respect to the pressure tube assembly is at a given pressure, mounting means for connecting each piston to a corresponding closure member, pressurizing means for pressurizing the inside of the pressure tube assembly to urge each piston out of the ends of the pressure tube assembly against the closure members to create longitudinal tension in the interconnecting wall of the outer shell and hoop tension in the walls of the pressure tube assembly whereby tension in the outer shell counteracts the compression forces to be applied on the structural member.

28. The structural member of claim 27 wherein the pressurizing means comprises adjusting means between at least one closure member and its corresponding piston for adjusting the distance between such closure member and its piston to move the piston into or out of the end of the pressure tube assembly to increase or to decrease the pressure in the pressure tube assembly.

29. The structural member of claim 28 wherein the adjusting means comprises a threaded opening in at least one of the closure member, and a threaded member threadably mounted in the threaded opening contacting the piston for moving the piston into or out of the pressure tube means upon turning the threaded member.

30. The structural member of claim 27 wherein the pressure tube assembly is filled with fluid.

31. The structural member of claim 30 wherein the fluid comprises small particle sized solids.

32. The structural member of claim 27 wherein the pressure tube assembly has lightweight hollow spheres inside.

33. The structural member of claim 27 wherein the pressure tube assembly comprises a wrapping of flexible material having high tensile strength.

34. The structural member of claim 33 wherein the wrapping is wound around a thin mandrel of material having a modulus of elasticity no greater than the modules of elasticity of the wrapping material.

35. The structural member of claim 33 wherein the flexible material is an aramid fiber.

36. The structural member of claim 33 further comprising an additional wrapping of a second flexible material having a tensile strength and modulus of elasticity greater than that of the first mentioned flexible material around the first mentioned flexible material at the portions of the pressure tube assembly near the ends thereof.

37. The structural member of claim 36 wherein the second flexible material is taken from the group comprising boron filament and graphite yarn.

38. A system for mounting a piston in a hydraulic cylinder for permitting relative movement between the piston and cylinder, the improvement comprising the provision of:

the piston having a base and a generally hollow columnar portion integral with and extending from the base inside the hydraulic cylinder, the columnar portion having an outside dimension slightly less than the inside dimension of the hydraulic cylinder and sealing means for sealing the space between the hydraulic cylinder and the columnar portion and for permitting axial movement therebetween whereby pressure in the cylinder which causes the cylinder to expand causes the columnar portion to flare outward to maintain the seal between the cylinder and the columnar portion.

39. A structural member comprising:

(a) an outer member of generally rigid material having a closure member fixed at each end of the outer member;

(b) a pressure tube having an inside length very much greater than its inside diameter;

(c) end members for sealing the ends of the pressure tube, at least one end member being movable with respect to the pressure tube;

(d) mounting means between the outer member and the pressure tube for mounting the pressure tube within the outer member for longitudinal movement of the pressure tube relative to the outer member whereby the end members contacts the closure members for force transmission, and the pressure tube is out of force transmission contact with the outer member; and (e) pressurizing means for pressurizing the inside of the pressure tube to urge the end members against the closure member and to radially load the pressure tube.

40. The structural member of claim 39 wherein the end members comprise a pair of piston seated in each end of the pressure tube, the mounting means mounting the pistons against the closure members.

41. The structural member of claim 40 wherein the mounting means comprises adjusting means extending between at least one piston and its adjacent closure member for adjusting the position of the piston relative to the closure member for changing the volume inside the pressure tube to modify the pressure in the pressure tube.

42. A structural member comprising an outer shell having fixed closure members at the ends of the outer shell and a connecting wall connecting the closure members, an elongated pressure tube assembly in the outer shell having an outer length very much greater than the inside diameter of the pressure tube assembly, at least one piston extending into a corresponding number of ends of the pressure tube assembly, mounting means for connecting each piston to a corresponding closure member, the pressure tube assembly being movable on each piston longitudinally with respect to the closure member, pressurizing means for pressurizing the inside of the pressure tube assembly to urge each piston out of the ends of the pressure tube assembly against the closure members to create longitudinal tension in the connecting wall of the outer shell and hoop tension in the walls of the pressure tube assembly whereby tension in the outer shell counteracts the compression forces to be applied to the structural member.

* * * * *